United States Patent [19]

Valéria

[11] Patent Number: 4,576,353

[45] Date of Patent: Mar. 18, 1986

[54] CARCASE, FAVORABLY FURNITURE-CARCASE

[75] Inventor: Hidvégi Valéria, Budapest, Hungary

[73] Assignee: Kozponti Valto-Es Hitelbank RT, Budapest, Hungary

[21] Appl. No.: 522,375

[22] PCT Filed: Nov. 25, 1982

[86] PCT No.: PCT/HU82/00062

§ 371 Date: Jul. 26, 1983

§ 102(e) Date: Jul. 26, 1983

[87] PCT Pub. No.: WO83/01890

PCT Pub. Date: Jun. 9, 1983

[30] Foreign Application Priority Data

Nov. 26, 1981 [HU] Hungary ..... 3544/81

[51] Int. Cl.[4] ..... F16M 11/00

[52] U.S. Cl. ..... 248/165; 297/440; 403/217; 108/153; 108/155

[58] Field of Search ..... 297/440, 441, 443, 444, 297/442, 457; 403/217, 384; 248/188, 188.1, 165, 150; 108/155, 153; 182/185, 186, 226, 225, 181

[56] References Cited

U.S. PATENT DOCUMENTS

| | | | |
|---|---|---|---|
| 1,256,235 | 2/1918 | Jacobs | 182/181 |
| 1,685,283 | 9/1928 | Gibson | 182/186 |
| 1,699,035 | 1/1929 | Tjelde | 182/226 |
| 2,158,939 | 5/1939 | Hussey | 182/226 |
| 2,706,661 | 4/1955 | Clayton | 403/217 X |
| 3,490,809 | 1/1970 | Lange | 297/440 |
| 4,167,908 | 9/1979 | Jones et al. | 108/153 X |

FOREIGN PATENT DOCUMENTS

| | | | |
|---|---|---|---|
| 873877 | 4/1942 | France | 182/186 |
| 2338011 | 12/1977 | France . | |
| 2401635 | 4/1979 | France | 297/440 |
| 216702 | 6/1924 | United Kingdom | 182/181 |

*Primary Examiner*—William E. Lyddane
*Assistant Examiner*—José V. Chen
*Attorney, Agent, or Firm*—Sughrue, Mion, Zinn, Macpeak & Seas

[57] ABSTRACT

The invention concerns to a carcase or framework, particularly for furniture. It has columns, interconnecting pieces attached to them and clamps joining the columns and interconnecting pieces. Essentially, the columns consist of parallel column members attached to each other. At least at two places—favorably at the ends of the column members—they are attached to each other by means of a coupling member overlapping two column members and/or intermediate interconnecting piece joining two columns via two releasable clamps. Each column member is clamped to the coupling member and/or the interconnecting piece. The carcase has interconnecting pieces which join the column members. They have sections dimensioned to the drift holes made by the notches on the facing surfaces of two column members. Adjacent these drift holes the interconnecting pieces have shoulders, edges or similar configurations which are supported by the column surfaces and which prevent displacement relative to the columns. The essence of the invention is that minimum expenditure of labor, material and energy provides furniture of high aesthetic level and use value. They are available to the customers in unit packets. The customer can assemble it himself without using any special tools or professional skill. The requirements for storage and transport is minimum. Due to the releasable attachments, the piece of furniture can be disassembled and no glue application to tapestry or mechanical clamping is required so that it can be easily removed and replaced in case of cleaning or substitution.

9 Claims, 21 Drawing Figures

FIG.1
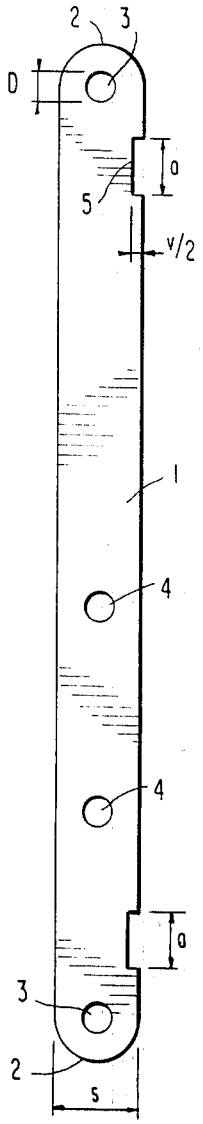
FIG.2
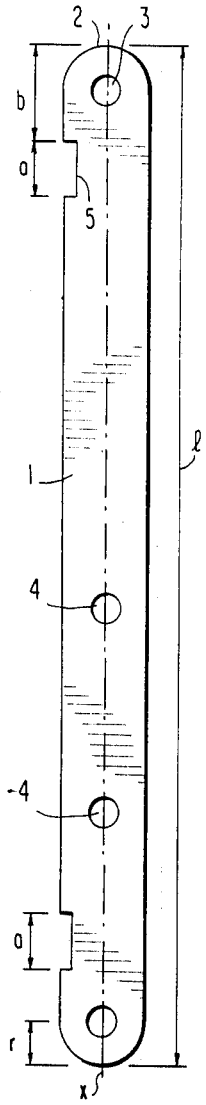
FIG.3
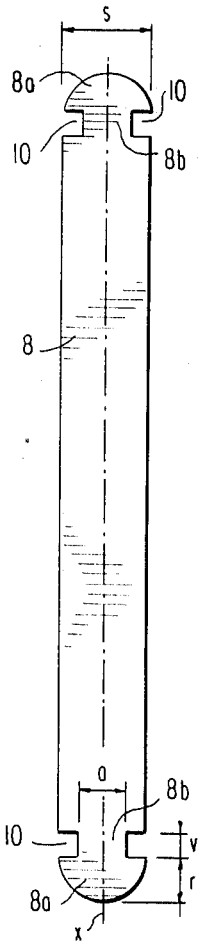
FIG.5
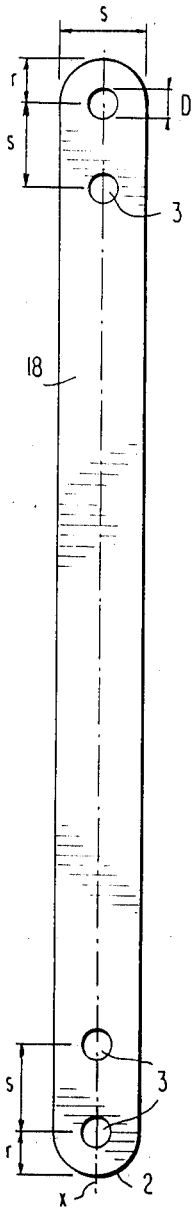
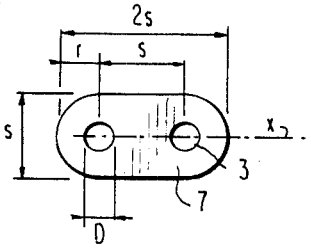
FIG.4

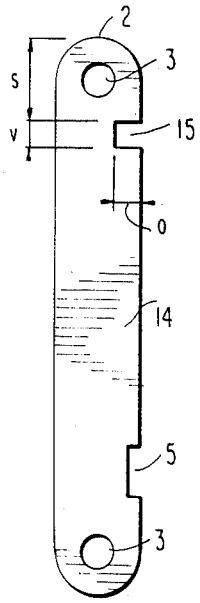
FIG.6
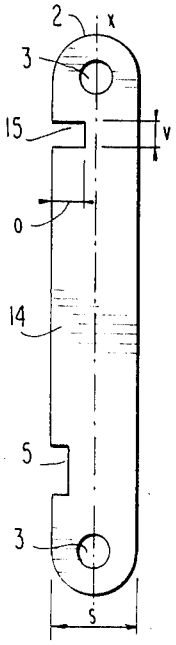
FIG.7
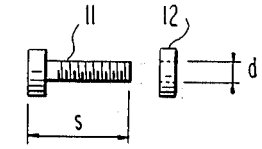
FIG.8
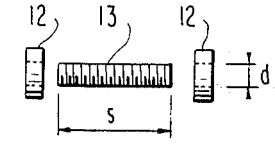
FIG.9
FIG.10a
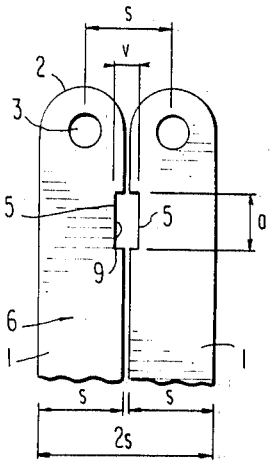
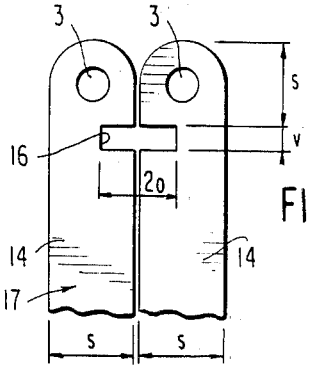
FIG.10b
FIG.11
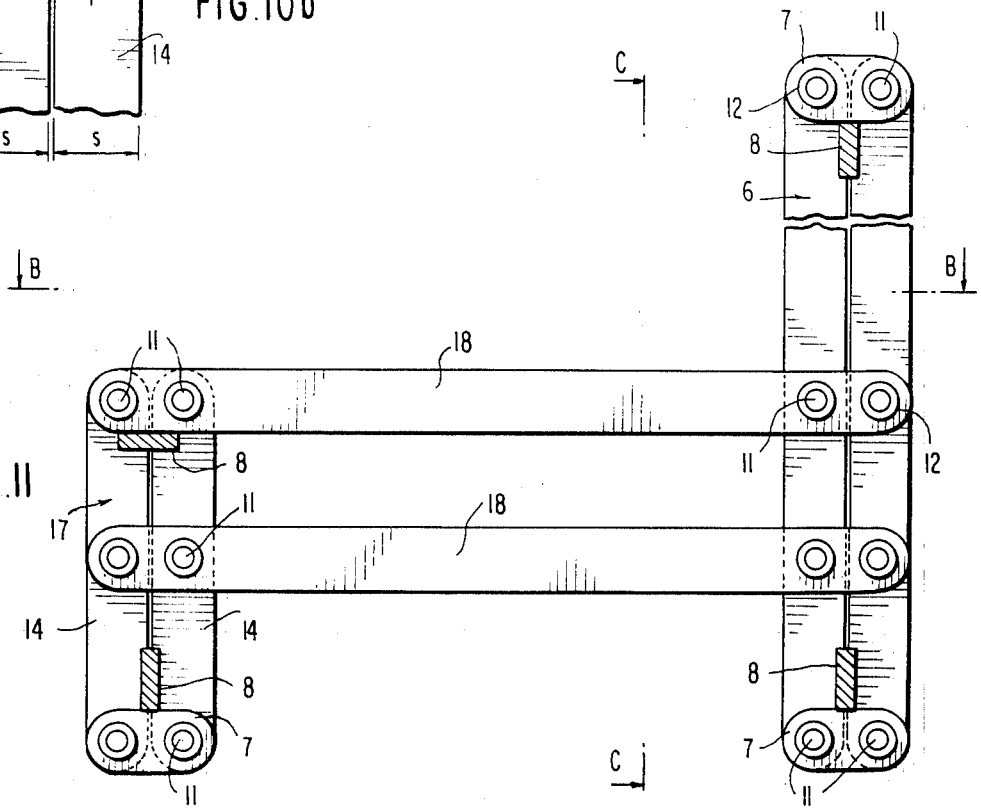

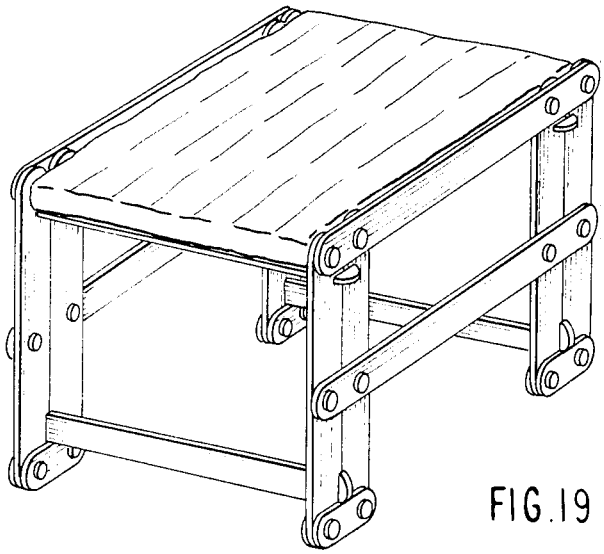
FIG. 19
FIG. 20
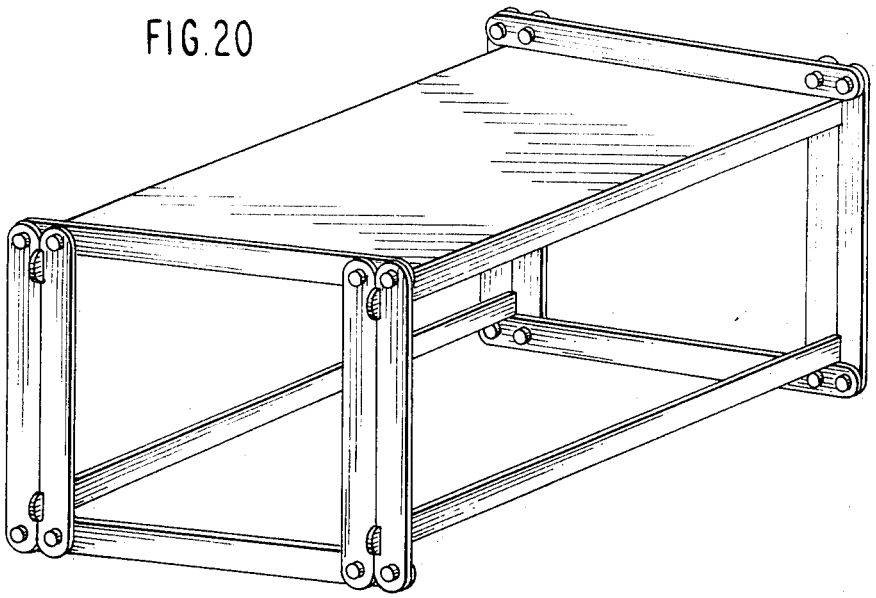

CARCASE, FAVORABLY FURNITURE-CARCASE

The invention refers to a carcase, especially a furniture carcase or framework which has columns, interconnecting pieces attached to them and clamps connecting the columns to the interconnecting pieces.

It is well-known that pieces of furniture are made of different materials, such as metal, plastic or commonly of wood. The different elements of furniture, made of wood, e.g. legs and backs of sitting furniture, panel fillings of cupboards, etc. are connected to each other mainly by permanent rigid, non-releasable joints, which can be detached only by destruction, because no rigid carcase can be made safely by applying present fastenings. E.g. a nut and bolt—breech block joining. Also such fasteners in practice are unacceptable in furniture production from the point of view of aesthetics, and if released result in collapsing of the building members.

The generally used scarf-glued joints provide a stiff connection between the building members unless they have not been used for a very long time, or under extreme loading when they are broken or torn at the glued site. It is difficult to mend them, and usually the entire piece of furniture is no longer serviceable.

Metal or plastic auxiliary members, e.g. wood screws, washers, tie plates, lag bolts, carriage bolts, etc., can be applied to joining wooden building members. Such stiff, practically unreleasable joints have the disadvantage that metal fastenings seize in the wood, joints become unaesthetic and are soon destroyed. Present-day furniture, especially sitting furniture, has some disadvantages, namely that much work and energy is needed for its production which is time consuming. A disproportionately large storage and delivery capacity is needed, as compared to the value and actual quantity of the objects, because the cupboards, sitting furniture and all pieces of furniture are bulky. It is difficult to place big pieces of furniture, e.g. carry them through narrow doorways, and often professional cleaning and mending is needed as a consequence of damage occurring in transportion.

The invention aims at providing a carcase, particularly a furniture carcase which has releasable and refixable points of connection so that the carcase can be rapidly and easily assembled and disassembled. At the same time the carcase is perfectly stiff and its members do not collapse even under extreme conditions or extended use. The carcase should also comply with the high level aesthetic requirements of furniture production.

The invention provides a carcase, comprising columns, interconnecting pieces attached thereto and clamps for joining the columns and interconnecting pieces together, characterized in that each column consists of two column members attached to each other in parallel relationship, such attachment being formed in at least in two spaced regions in the column members by means of respective coupling members overlapping both column members by pairs of releasable clamps in such a way that each column member is clamped to the coupling member, said interconnecting pieces comprising respective sections fitting in drift holes defined by notches in the mutually facing surface of the opposing column members, wherein in the region of said drift holes the interconnecting pieces have shoulders, edges or similar configurations which are supported by the column surfaces to prevent the interconnecting pieces being displaced relative to the columns. The carcase has easily releasable joints. It is perfectly stiff and provides perfect protection against collapsing.

On the basis of this recognition the invention aimed at constructing such a carcase which has columns, interconnecting pieces, attached to them, as well as clamping members connecting the columns to the fastenings. Essentially, the columns are made of two joined parallel members. Both columns members are joined at least at two locations, favourably at the ends, by applying another interconnecting piece to join the columns with at least two releasable fasteners or clamps. Both column members are joined to the interconnecting piece. The carcase has such interconnecting pieces which have sections attached to drift holes formed by notches in the opposed surfaces of the two column members. The interconnecting pieces at the drift holes, have shoulders, edges or similar figures, supported by the column surfaces which prevent their displacement relative to the columns. The releasable clamps are preferably threaded shanks passing through aligned holes and secured by nuts. They are applied to join the column members by the interconnecting pieces and/or clamps.

In one favourable embodiment of the carcase, the column members, interconnecting pieces and the clamps are oblong-like, of a width greater than their thickness and length greater than their width. Expediently, the centres of the hole are on the longitudinal geometrical axis of the carcase members. Their diameter is bigger than that of the threaded shanks and less than that of the nuts. Favourably, the hole diameters correspond to those of the screw shanks.

According to another embodiment the holes are located inwardly from the ends of the members, by half of the member's width. It is also favourable if the length of the interconnecting pieces is double their width and if the column members have intermediate through holes.

Another embodiment is characterized as having notches on at least one side surface of the column members, expediently near the ends of the column members. They create through drift holes when the column members are joined side by side. Favourably the notches are rectangular-like. The length of the notches is bigger than their depth. Expediently, the depth is equal to half of the column member's thickness or the depth of the notches is bigger than their length. Favourably, its length is equal to the thickness. Naturally, there can be other notch configurations, too. In another embodiment, there are notches in the column members near to each other which are long but not too deep, and some others which are not so long but deep.

Another favourable embodiment is characterized in having at least one interconnecting piece which joins two slab-shaped columns perpendicularly to the larger side surfaces. Near its ends it has notches in the narrow sides opposite to each other, defining collars adjusted to the through drift holes of the columns, as well as heads outside the columns' sides. Expediently, the width of the notches must be the same as the thickness or very similar to it, and the planes near to the member's ends are within a distance which is not bigger than half of its width. The width of the collars must be equal to the longer side of the columns' oblong drift holes.

According to another embodiment, the carcase has at least one interconnecting piece which joins two slab-shaped columns in a plane parallel with their larger surfaces. Near its ends it has two through holes. The one nearer to the end is at a distance equal to half of the member's width. Other holes are at a distance from the external holes equal to the width of the member. From aesthetical point of view, the carcase seems to be favourable if the slab-shaped, expediently oblong carcase members' ends are rounded-off. Favourably, the round-off ends are semi-circular, and the radius of the semi-circle is equal to the half of the width of the carcase members.

The invention is described in greater detail with reference to the accompanying drawings. They include some pieces of furniture, made by applying the carcase, and preferred embodiments of the points of junction and those of the carcase.

In the drawings:

FIGS. 1 and 2 show the profile of two column members;

FIG. 3 shows the profile of the interconnecting pieces made of the column members, shown in FIGS. 1 and 2, which can be applied to the columns without any clamp;

FIG. 4 shows the profile of an interconnecting piece;

FIG. 5 shows such an interconnecting piece which can be attached to the columns by releasable clamps externally; they are made of the column members, shown in FIGS. 1 and 2;

FIGS. 6 and 7 show other embodiments of column members;

FIGS. 8 and 9 show the profile of embodiments of clamps;

FIG. 10*a* shows the upper end of two column members, of the kind shown in FIGS. 1 and 2, positioned side by side;

FIG. 10*b* shows the upper end of the column members of FIGS. 6 and 7 positioned side by side;

FIG. 11 is a vertical section on the line A—A in FIG. 2 of the carcase of an armchair, made of members shown in FIGS. 1–10*b;*

Figure 12:
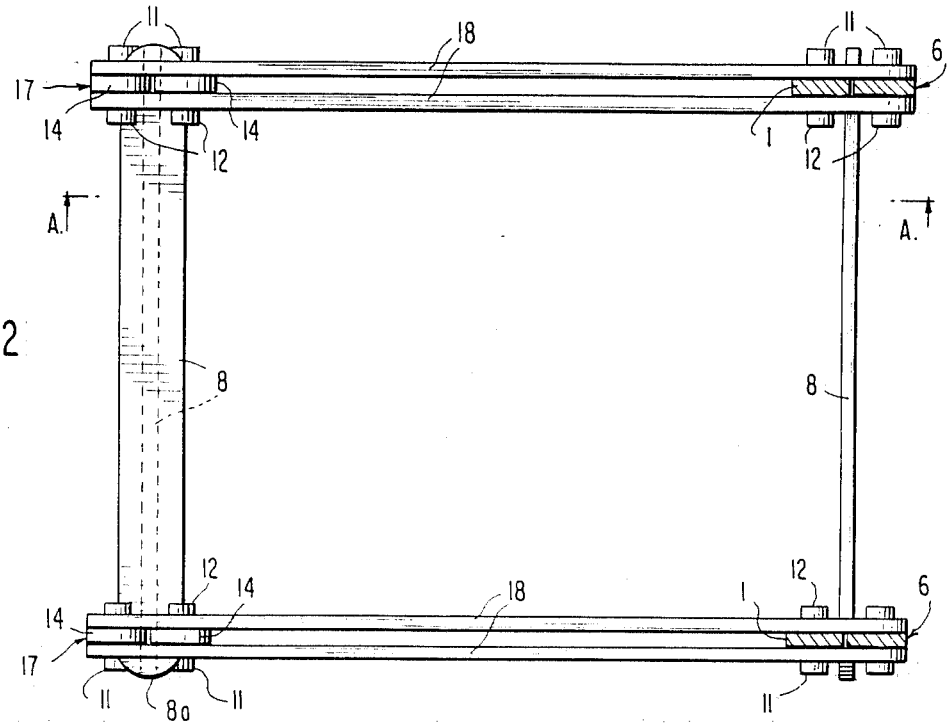
Figure 13:
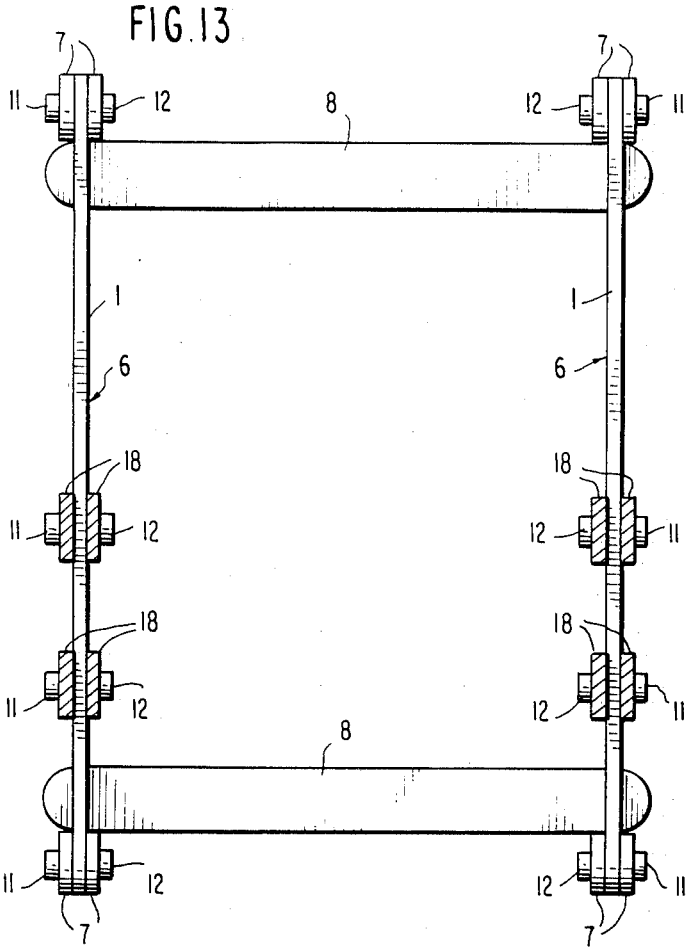
Figure 16:
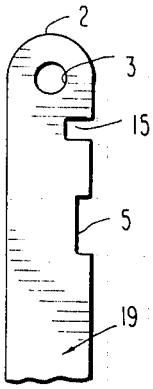
Figure 17:
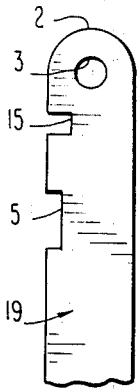
Figure 14:
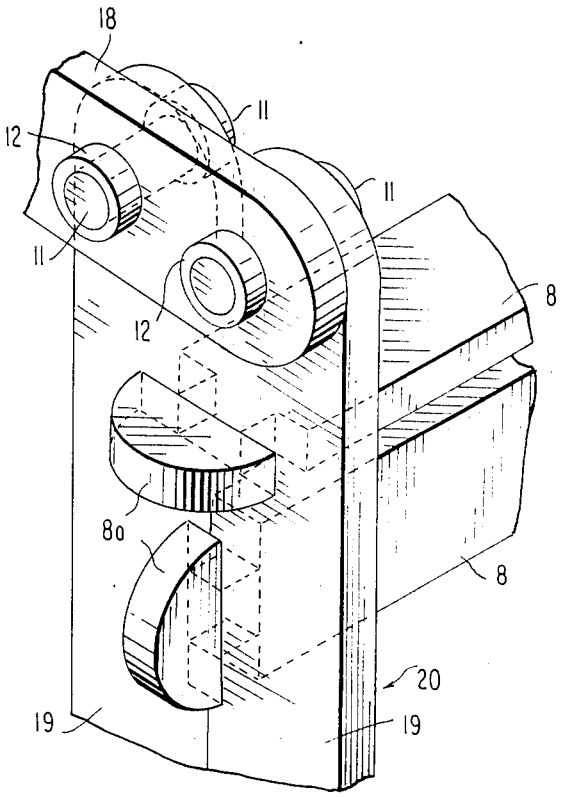
Figure 15:
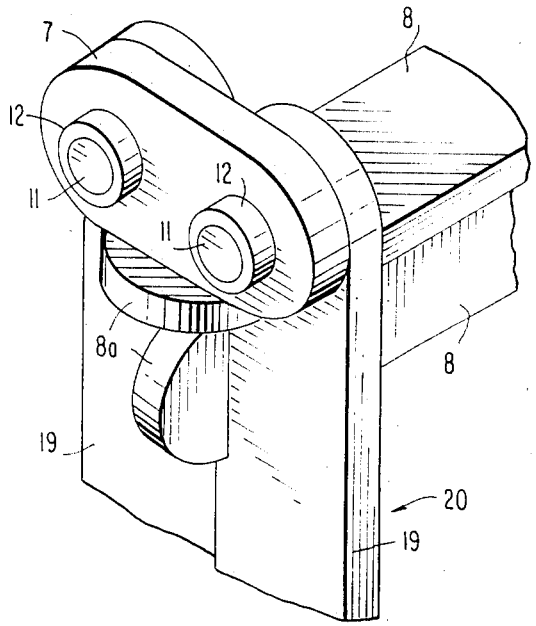
Figure 18:
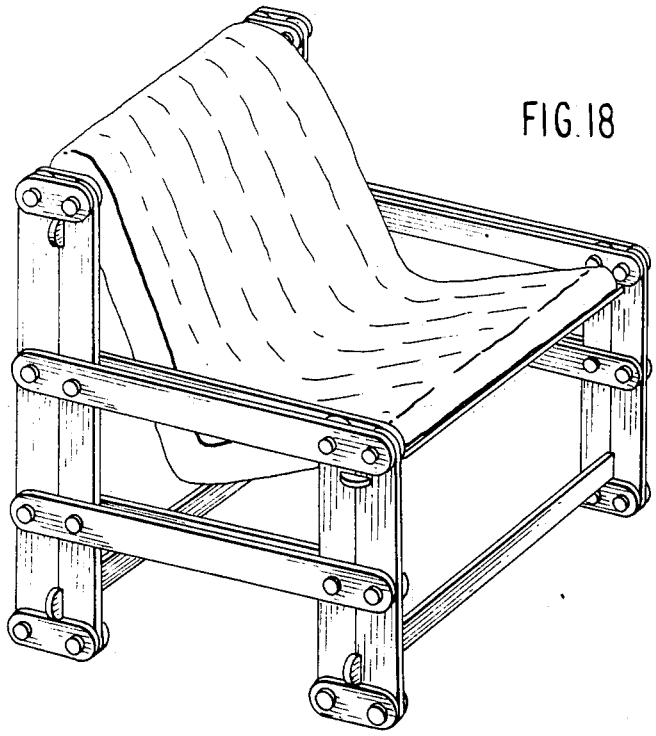

FIG. 12 is a horizontal section on the line B—B indicated in FIG. 11;

FIG. 13 is a vertical section on the line C—C indicated in FIG. 11;

FIG. 14 is a perspective view of a joint, to which two cross sections of the same direction, perpendicular to one another are attached;

FIG. 15 shows a joint, similar to the one shown in FIG. 14, but instead of the third cross member the column members are joined by a coupling member;

FIGS. 16 and 17 show the side view of the column members, used in the joint shown in FIG. 14;

FIG. 18 is a perspective view of the armchair shown in FIGS. 11–13;

FIG. 19 shows a smoking table; and

FIG. 20 is a perspective view of a small seat.

The carcase members shown in FIGS. 1–7 are all made of wood. The column members 1 shown in FIGS. 1 and 2 are oblong, slab-shaped bodies, e.g. their length 1 is 90 cm, width s is 7 cm, thickness v is 16 cm. Their ends are rounded-off semi-circularly at 2. In the centre of the round-offs there are holes 3 with a diameter of D. Their centres are at distance r from the ends, on the geometrical longitudinal axis x of the members. On the same axis there are further through holes 4 near the lower end of the column members 1. The radius of the round-off r equals with half of the width s.

In the upper and lower ends of the column members 1 there are notches 5 on one of the longitudinal sides. The length of notch 5 is s, and its depth is v/2—where v is the thickness of the members. The notches 5 are at a distance b from the ends, and the geometric dimensions are chosen so that b>a.

When the column members 1 shown in FIGS. 1 and 2 are closely attached to each other in such a way that their notches 5 could face each other, two confronting notches 5 will form a through drift hole 9 as can be seen in FIG. 10*a*. The height of the drift hole 9 is a, width v and depth v. Two column members 1 placed side by side will form a column 6 (FIG. 10*a*). Two column members 1 of each column 6 are attached to each other by the coupling members 7 (shown in FIG. 4) of length 2s, and width s. There are two holes 3 in the geometrical longitudinal axis x, which are at a distance s/2=r from the round-off ends of the member 7 and at the distance s from each other. The appropriate geometrical relationship and dimensions have already been given in relation to FIGS. 1 and 2. When a coupling member 7 shown in FIG. 4 is attached to the upper ends of the side by side column members 1 shown in FIG. 10*a* the releasable clamps are passed through the aligned holes 3 and a similar connection is established between the lower ends of the column members 1, to form a perfectly stiff column 6 from the column members 1 connected to each other at two points. (See the description in connection with FIGS. 11–13, too.) A fastener or clamp can be a device made of a wooden bolt 11 and a nut 12 as shown in FIG. 8, or of a threaded pin 13 and nuts 12 as shown in FIG. 9. Their length a, the diameters of shanks and holes d are chosen according to the geometric relationships of the above details and the difference between d and D is minimal but sufficient to allow the threaded shanks 11, 13 to be passed through the holes 3.

The column members 14 seen in FIGS. 6 and 7 differ from the ones shown in FIGS. 1 and 2, as they are shorter, and the shapes of notches 15 in their upper ends differs from that of the notches 5. However, the similar structural members and dimensions have been marked with reference numbers and letters as shown in FIGS. 1 and 2. The width of notch 15 is v, depth is o, b<s/2. The width v is chosen so that a slab-shaped member can be put into the drift hole 16 created by two notches 15, (see FIG. 10*b*). By attaching two column members 17 side by side, as shown in FIG. 10*b* and joining them with coupling members 7 (FIG. 4) and clamps as shown in FIGS. 8 and 9, a stiff column 17 is obtained, (see FIGS. 11–13).

Two columns 6 and 17 which are placed at a distance from each other, can be joined by the interconnecting pieces 8 shown in FIG. 3 and/or by interconnecting pieces 18 shown in FIG. 5. The pieces 8 and 18 are rod-like plate members whose width and thickness are the same as those of the column member 1 shown in FIGS. 1 and 2. The geometrical dimensions are marked with reference letters. The interconnecting piece 8 shown in FIG. 3, which provides a rigid coupling perpendicularly to the slab-shaped plane of the column 6 between columns at a distance from each other. It is provided with notches 10 of width v at its ends. The width of collar 8*b* is equal to the height of the drift hole 9 shown in FIG. 10*a*. The coupling member 8 at the ends has heads 8*a* of width s. If the collar 8*b* of the member 8 is adjusted to the dimension drift hole 9 of the columns 6 and then the neighbouring column members 1 are joined as previously described (FIG. 10*a*) by means of clamps 11 and 12 there will be a perfectly safe clamp between the column members 1 and the interconnecting piece 8, i.e. a rigid "dry" coupling widthout the application of glue. The bolts 11, 13 provide perfect protection against collapsing. The shoulders of the drift holes 10 supported by the external planes of the column 6 protect the interconnection piece 8 from longitudinal displacement.

A two-pointed, safe connection can be obtained by applying an interconnecting piece 18 shown in FIG. 5, which provides a rigid coupling parallel with a slab-shaped plane of the columns 6, between the two columns which are at a distance from each other. This interconnecting piece 18 is also slab-shaped, of width s and thickness v, and as long as is required by the carcase. There are two through holes 3 of diameter D near the ends of the piece 18 on the geometric longitudinal axis x. The holes 3 of each pair are at a distance s from each other, the outermost ones being at a distance 20 cm=r from the rounded-off ends. The spacing of the holes is the centre-to-centre spacing. Where the interconnecting piece 18 is applied in joining two spaced slab-shaped columns, (FIG. 10*a*) or the columns 17 (FIG. 11) at their upper and/or lower ends, use of the coupling member 7 as shown in FIG. 4 is unnecessary as the ends of the interconnecting piece 18 fulfill the role of the coupling member 7 (i.e. fixing at two points) perfectly on insertion of the coupling members 12, 11 or 13, 12 as shown in FIGS. 8 and 9. The slab-shaped interconnecting piece 8 is adjusted to the drift hole 9 of the column 6 set on edge, as shown in FIG. 10*a*. Its plane is perpendicular. The interconnecting piece 8 is adjusted to a drift hole 16 of the column 17 as shown in FIG. 10*b*, so that its plane is horizontal in the carcase. Naturally, in the former case the interconnecting piece has a bigger load capacity. The position of the interconnecting piece 8 in the carcase is decided by the conditions of application. Statistical, aesthetical and functional aspects also exert their influence on it.

An armchair carcase is shown in FIGS. 11–13, made from the members as shown in FIGS. 1–10*b*. The armchair has two columns 6 (FIG. 10*a*) and two columns 17 (FIG. 10*b*) forming the legs of the armchair. The upper sections of the columns 6 are the vertical supports of the back. The shorter front columns 17 and the longer rear columns 6 are joined by two interconnecting pieces 18. They are always fixed by four clamp sets 11, 12 as shown in FIG. 12 (two-point clamping). The upper interconnecting pieces 18 serve as the elbow-rests of the armchair, the lower one is a stiffener support—e.g. for the seating cushion. The lower section 14 of the columns 17 and the upper and lower sections of the columns 6 are fixed by the coupling members 7 and clamps 11, 12.

Transverse joining of the columns 6, 17, perpendicular to the plane of FIG. 11 is done by two interconnecting pieces 8 (FIG. 3). The front upper interconnecting piece is horizontal, the other three are vertical. This carcase can be rapidly assembled and disassembled without special tools or professional skill. Only the nuts 12 must be screwed or unscrewed on the bolts 11. The cushion of the chair can be supported by a web of canvas with folded and sewn edges. The web can be strung between the front lower and rear upper spread bars 8. They are fixed in the points of function. The supporting canvas web can be attached to the carcase without glue or interconnecting pieces. It can be pulled off the carcase simply by releasing the clamps at the points of junction. The canvas web can be tightened additionally so as to support the sitting cushion. Naturally, the web itself of linen or leather can serve as accessories to the furniture.

FIG. 14 shows such a joint which includes the carcase members shown in FIGS. 1–10, with the difference that at the ends of the column members 19 as shown in FIGS. 16 and 17 there are adjacent notches 5, 15 which are identical with the notches 5, 15 of the column members 14. This geometrical form of the column member allows that two interconnecting pieces 8 to be attached to the end of column 20 shown in FIG. 14, one of which—the upper one—has a horizontal plane, and the other—the lower one—has a vertical plane. An interconnecting piece 18 is also attached to the joint and functions as an auxiliary for the two-point clamping of the column members 19. The interconnecting piece 18 is perpendicular to the interconnecting pieces 8. The joint, the positioning, and the rectangular retentivity can be provided by accurate wood processing. Protection from sliding, and joining of bars starting from the joint in three directions are provided by the releasable clamps 11, 12 alone. The collaboration of members, and the perfect stiffening of the carcase are provided by the interconnecting piece 18 fixed in two points and adjusted overlappingly. As the loads occurring are taken up in shear, stability is properly provided.

The joint shown in FIG. 15 differs from the one shown in FIG. 14 because the interconnecting pieces 8 are nearer to each other, and in accordance with this the notches 5, 15 of the column members 19, and the rigid, two-point junction of the column member 19 is provided by the coupling member 7 shown in FIG. 5. Two-point junctions of the joints shown in FIGS. 14 and 15 are provided by clamps 11, 12 as shown in FIG. 8.

Two interconnecting pieces 8 are applied to a carcase under heavy load and of larger span as shown in FIGS. 14 and 15. Their application can be accounted for by applicational-aesthetical reasons, too.

Other advantages of the invention are as follows:

It is not necessary to mount and clamp the carcase member (tap, glue, screw, process, thread-cut, etc.) in the factory. Expenditure of tools, labour and material is much less. The carcase members for a furniture set can be gathered into a solid, small sized pocket. There is less space required for storage and transport, in comparison to traditional pieces of furniture. From a statistical point of view the carcase needs no plate members as are usually required for stiffening load bearing functions in present day furniture systems. They can however be applied as auxiliary interlocks or additional pieces, e.g. in tables, shelves, cupboards, etc. No professional skill is needed for assembly either. A customer can mount the carcase from the members of the unit packet in little time without specialized tools. No breaking or seizing of the joints occur, even under extreme conditions of application, in contrast with experience in the use of metal clamps. Wooden clamps (threaded pins) are able to take elastic deformation. Wood cracking indicates high load before breaking. The two-point clamping joints are so stable that the increase in furniture dimensions or span only require increased length of carcase members. Bridging of a larger span can be provided by adding accessory interconnection pieces (preferably set on edge) see FIGS. 14 and 15. They are highly important. If a piece of furniture is to be moved it can be disassembled very rapidly and transported as a packet. Textile, leather, etc. accessories need not be nailed or glued, but can be easily attached to the carcase members. The furniture does not require any permanently attached upholstery. Where necessary the upholstery can be removed e.g. in for cleaning or changed. According to the tastes and financial means of the customers different needs can be met. The joints due to their rapid releasibility and construction allow further building and transformation e.g. by applying some auxiliary members an armchair can be transformed into a table, etc. so that the flexibility of the set of furniture can be increased. As a result of these factors, the novel furniture is much more economical and less expensive than the traditional ones, its use value is higher, and the aesthetic level—because of the rustic form, simple design, etc.—is also high.

Naturally, the invention is confined neither to the building styles or embodiments described above nor to the specific form of the carcase members, forms, clamps, etc. but it can be carried out within the scope as defined by the claims. Beyond doubt the application of lumber carcase members and clamps seems to be the most expedient from the point of view of aesthetics and utilization, but other members, made of materials other than wood e.g. plastic an also be used. Instead of the oblong, slab-shaped column members with rounded-off ends and coupling members, carcase can be made from bar-like members of different cross-sections and shapes; bar cross sections can be rectangular, e.g. square, and tabs of other bars can be adjusted to their drift holes. It goes without saying that the members can differ from each other in length, width, thickness, shape, number of holes, etc. The clamps need not always be threaded shanks and nuts, and in certain cases clamping can be provided by keys or cotter pins, too.

I claim:

1. A furniture framework comprising:

column members constituting elongated flat bars having narrow sides, two end regions, and wherein each of said column members has notches within a narrow side thereof remote from said end regions;

columns formed by respective pairs of said column members attached to each other in a narrow side-by-side arrangement, each of said column members including respective through holes normal to flat faces thereof in at least said two end regions;

coupling members constituting elongated flat bars extending normal to said pairs of column members and overlapping said end regions, said coupling members having respective through holes;

releasable clamps insertably carried by said through holes of said coupling members and said column members, whereby said pairs of column members are connected together in both end regions in said side-by-side arrangement, said columns comprising drift holes defined by said notches in the mutually facing narrow sides of opposing column members, said drift holes being arranged inwardly from and in proximity to said clamp connection of said column members;

and interconnecting pieces constituting flat bars for interconnecting respective pairs of said columns, said interconnecting pieces comprising respective neck portions of said flat bars fitting said drift holes, whereby said columns engage and hold said interconnecting pieces.

2. The framework as claimed in claim 1, wherein said through holes are arranged in the axis of symmetry of said column members and coupling members.

3. The framework as claimed in claim 2, wherein said column members, said coupling members and said interconnecting pieces constitute flat bars having a common width and thickness.

4. The framework as claimed in claim 3, wherein said column members, said coupling members and said interconnecting pieces have rounded ends.

5. The framework as claimed in claim 3, wherein said through holes are arranged at a distance from the ends of said members correspond substantially to the half-width of the members.

6. The framework as claimed in claim 1, wherein said notches and said neck portions have oblong-like rectangular profiles.

7. The framework as claimed in claim 6, wherein a plurality of interconnecting pieces are arranged in proximity to an end region of a column including at least one of said interconnecting pieces extending parallel to the longitudinal axis of the column members and at least one other of said interconnecting pieces extending normal thereto.

8. The framework as clamed in claim 1, further comprising additional coupling members each having respective pairs of said through holes in two end portions, said columns further including pairs of through holes remote from the end portions and said further coupling members interconnecting pairs of said columns by clamps inserted in respective pairs of further through holes and providing further coupling between the coupling members in each of said columns.

9. The framework as claimed in claim 1, wherein said clamps are threaded bolts and nuts.

* * * * *